US005439776A

United States Patent [19]

Pilot et al.

[11] Patent Number: 5,439,776

[45] Date of Patent: Aug. 8, 1995

[54] ISOTHIOURONIUM SALTS AS PHOTOGRAPHIC NUCLEATING AGENTS

[75] Inventors: John F. Pilot, Carteret; Syeda Husain; Shirley Madamba, both of Middletown, all of N.J.

[73] Assignee: Sun Chemical Corporation, Fort Lee, N.J.

[21] Appl. No.: 339,857

[22] Filed: Nov. 15, 1994

[51] Int. Cl.[6] ..... G03C 1/06

[52] U.S. Cl. ..... 430/264; 430/598; 430/603; 430/410

[58] Field of Search ..... 430/264, 598, 603, 410

[56] References Cited

U.S. PATENT DOCUMENTS

| | | | |
|---|---|---|---|
| 3,220,839 | 11/1965 | Herz et al. | 430/428 |
| 4,030,925 | 6/1977 | Leone et al. | 430/217 |
| 4,975,354 | 12/1990 | Machonkin et al. | 430/264 |
| 4,988,604 | 1/1991 | Machonkin et al. | 430/264 |
| 4,994,365 | 2/1991 | Looker et al. | 430/598 |
| 5,126,227 | 6/1992 | Machonkin et al. | 430/264 |
| 5,158,856 | 10/1992 | Usagawa et al. | 430/264 |
| 5,229,248 | 7/1993 | Sanpei et al. | 430/264 |
| 5,264,323 | 11/1993 | Purol et al. | 430/264 |
| 5,340,704 | 8/1994 | Ezoe et al. | 430/264 |
| 5,382,496 | 1/1995 | Sakai et al. | 430/264 |

*Primary Examiner*—Thomas R. Neville
*Attorney, Agent, or Firm*—Jack Matalon

[57] ABSTRACT

The inclusion of isothiouronium functionality onto hydrazide derivatives results in the formation of nucleating agents for lithographic films that produce high contrast and speed with excellent dot quality as required for halftone applications. The level of performance of the nucleators of the invention is sufficiently high that the need to incorporate amine boosters in the lithographic film elements or developers is not required. The novel nucleators have the formula

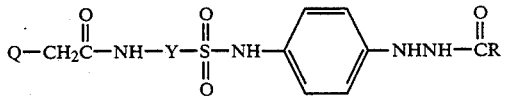

wherein R is hydrogen, $C_1$–$C_{10}$ alkyl, substituted or unsubstituted carbamoyl, or alkoxy or aryloxy carbonyl; Y is substituted or unsubstituted divalent aryl, and Q is an isothiouronium salt moiety.

13 Claims, No Drawings

ISOTHIOURONIUM SALTS AS PHOTOGRAPHIC NUCLEATING AGENTS

FIELD OF THE INVENTION

This invention relates to photographic films and to compounds employed in photographic films to promote high contrast, improved dot quality, and higher photographic speed of imagewise exposed films. The invention particularly relates to lithographic films containing novel hydrazides that incorporate an isothiouronium salt moiety in the molecular structure. The invention also relates to the process for forming a high contrast image by employing the novel nucleators of the invention without the aid of boosters.

BACKGROUND OF THE INVENTION

The utilization of silver halide technology in the Graphic Arts Industry has been primarily focused on the creation of high contrast systems, which are necessary to obtain strong discrimination of image and good image quality-dot characteristics. To this end, the earliest high contrast system, which is called the "lith" system, utilized a low sulfite, hydroquinone based developer with silver chlorobromide emulsions, further modified by polyethyleneoxide compounds.

The "lith" system provided high contrast, excellent image discrimination and good "dot" characteristics. The single greatest drawback of the system was the instability of the developer system which required a multi-part, compound developer and a low temperature (75°-80° F.) processing solution in order to maintain controlled developing solutions. These conditions further necessitated long processing times, sometimes as much as 2½ minutes for development, but more commonly 1½ minutes. The process was further complicated by the fact that "non-lith" films were frequently also processed in the same developers due to convenient configurations at various customers.

In order to increase development rates and lower processing times, the Graphic Arts Industry gravitated to the use of auxiliary developing agents in addition to hydroquinone. These agents include metol, phenidone, and the like. Simultaneously, to increase developer life, the developing solutions employed higher concentrations of sulfite to extend the lifetimes of the solutions, increase their resistance to aerial oxidation, afford greater uniformity of developer condition, and allow an increase in development rate by increasing the temperature of the processing solution. These new "rapid access" developers were simpler to maintain, dilutable, and required about 30 seconds of development time, affording faster throughput, ease of operation, and greater compatibility with non-lith type films. The single greatest drawback of these systems was the lack of the excellent image discrimination and dot characteristics that had been achieved with the lith system.

In U.S. Pat. No. 3,730,727, the use of formyl phenylhydrazines incorporated in the developer is discussed to improve image discrimination without the use of the low-sulfite lith techniques. It was shortly brought to practice in the "lith" system described in U.S. Pat. No. 4,224,401, which describes a lith-type result with a high pH, high sulfite-type developer solution. In U.S. Pat. No. 4,269,929, the system is further refined by employing alkanol amines to lower the operable pH of the developer to practical levels, thus permitting commercialization of the type of developer known as "hybrid" developer. Hybrid developers provide the results of lith developers but at rapid access developing speeds.

Subsequent to the foregoing disclosures, U.S. Pat. Nos. 4,686,167, 4,798,780, 4,937,160, and 4,882,261, all disclosed novel hydrazine "nucleators" which afforded the hybrid effect.

While hybrid systems have been commercialized, the flaw of the hybrid system resides in the alkanol amines incorporated within the developer solution to boost or promote high contrast. These amines, which still required a pH of 11.0 or greater, had the adverse effects of attacking the processor equipment and were basically incompatible with a great variety of non-hybrid lithographic films that were frequently processed in the same chemistries.

An approach to overcome the flaws of developer solutions containing alkanol amine was disclosed in U.S. Pat. Nos. 4,975,354 and 4,994,365. These patents taught a new hybrid system which removed the alkanol amines from the developer and positioned them in the film. These amines, ostensibly called boosters, were to activate the film incorporating the hydrazine nucleators, thus making them compatible with standard, low cost developing solutions.

The drawback of the systems which incorporated the alkanol amine boosters into the film containing the nucleators was the complexity of balancing the nucleator with the boosters to provide good discrimination at low fog or pepper levels while broadening the degree of compatibility with a number of existing rapid access developer systems.

To this end, U.S. Pat. No. 4,994,354 described the use of alkyl substituted, quaternary pyridine nucleators and U.S. Pat. No. 4,988,604 described the use of aryl sulfonamidophenyl hydrazide nucleators containing both thio and ethyleneoxide groups which were compatible with boosters and afforded good discrimination and good dot characteristics. The drawback of this system is the interaction of the nucleator and booster. That interaction limits the system's compatibility with many existing rapid access systems.

It is an object of the present invention to provide nucleator compounds having contrast enhancing properties superior to those in the prior art in conjunction with high dot quality and speed so that photographic film can be produced without a need for incorporating nucleation boosters in the formulation.

It is another object of the invention to produce superior nucleator compounds that incorporate isothiouronium salts in the formulae or structures of the compounds.

Yet another object of the invention is to provide photographic film elements that produce a high contrast image without requiring the use of nucleator boosters by incorporating nucleators in the film comprising isothiouronium substituted sulfonamidophenyl hydrazides.

A further object of the invention is to provide a process for forming a high contrast image by employing novel nucleators comprising isothiouronium substituted sulfonamidophenyl hydrazides.

SUMMARY OF THE INVENTION

The present invention is derived from the discovery that the inclusion of isothiouronium functionality onto hydrazide derivatives results in the formation of nucleating agents for lithographic films that produce high contrast and speed with excellent dot quality as required for halftone applications. Moreover, the level of performance of the nucleators of the invention is sufficiently high that the need to incorporate amine boosters in the lithographic film elements or developers is eliminated. Therefore, use of the high performance nucleators of the invention effectively removes from further consideration all of the ecological, cost and performance problems associated with contrast enhancing amine boosters in lithographic films.

The high performance nucleators of the present invention are isothiouronium salt derivatives of aryl sulfonamidophenyl hydrazides. They are included in the film element in conjunction with the production of the silver halide emulsion coated film. Imagewise exposure of the film and development in conventional rapid access developers provides superior image gradients and dot quality. The nucleators of the invention have the following molecular structure:

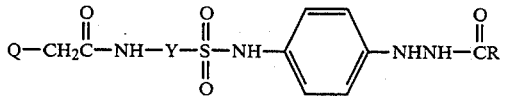

wherein R is hydrogen, $C_1$–$C_{10}$ alkyl, substituted or unsubstituted carbamoyl, or alkoxy or aryloxy carbonyl; Y is substituted or unsubstituted aryl, and Q is an isothiouronium salt moiety having the structure

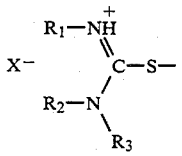

wherein $R_1$, $R_2$ and $R_3$, alike or different, are selected from the group consisting of hydrogen, substituted or unsubstituted phenyl and phenyl hydrazide, cycloalkyl, $C_1$–$C_{12}$ alkyl and alkenyl, substituted and unsubstituted pyrrolidyl and piperidyl and aryl carbohydrazide; and X is an inorganic or organic anion, but preferably chloride.

More preferably, the photographic film nucleating agents of the invention have the structure

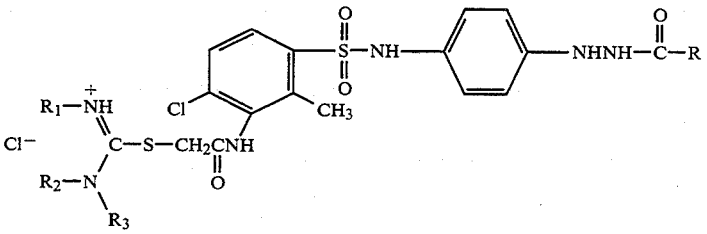

wherein R is hydrogen or N-(2,2,6,6-tetramethyl-4-piperidyl)-carbamoyl, or ethoxy carbonyl; $R_1$ is 2,2,6,6-tetramethyl-4-piperidyl, n-butyl, methyl or hydrogen; $R_2$ is n-butyl, methyl or hydrogen, or phenyl hydrazino ethoxylate; and $R_3$ is hydrogen or n-butyl.

The film element of the invention is prepared by coating a substrate with a silver halide emulsion containing the novel isothiouronium salt derivatives of aryl sulfonamidophenyl hydrazides.

DETAILED DESCRIPTION OF THE INVENTION

A new class of nucleators for graphic arts films has been found that is distinguished over others reported in the prior art by the presence of isothiouronium salt functionality. The general structure for these materials is depicted below (I). These nucleators increase the speed and contrast of lithographic films and also improve the dot quality for halftone applications. Some of the advantages they impart to lithographic films are summarized by the following list:

* high contrast, which provides excellent sharpness to the edge of the image;
* excellent dot quality, equal or better to the current state of the art;
* high photographic speed, which is suitable for halftone films;
* as an added benefit, the use of these nucleators does not require "boosters" to provide good dot quality and speed.

The novel nucleators of the present invention fall within those isothiouronium salt derivatives of aryl sulfonamidophenyl hydrazides having the general structure

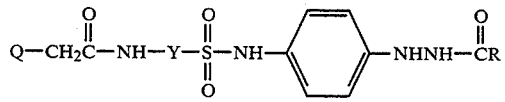

I.

wherein R is hydrogen, $C_1$–$C_{10}$ alkyl, or substituted or unsubstituted carbamoyl, or alkyloxy or aryloxy carbonyl; Y is substituted or unsubstituted divalent aryl, and Q is an isothiouronium salt moiety having the structure

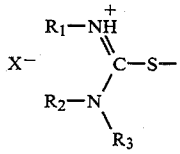

wherein R1, $R_2$ and $R_3$, alike or different, are selected from the group consisting of hydrogen, phenyl or phenyl hydrazide, cycloalkyl, $C_1$–$C_{12}$ alkyl or alkenyl, substituted and unsubstituted pyrrolidyl and piperidyl and aryl carbohydrazide; and X is an inorganic or organic anion, preferably chloride.

Particularly preferred aryl carbohydrazide substituents for the isothiouronium salt moiety include those substituents produced by reaction of the moiety precursor with Intermediates A, B or C which are depicted hereinafter.

The foregoing substituted or unsubstituted carbamoyl has the following structure wherein $R_4$ and $R_5$, alike or

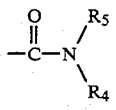

different, are selected from the group consisting of hydrogen, alkyl, alkenyl, aryl, pyrrolidyl and piperidyl.

The preferred piperidyl group comprises 2,2,6,6-tetramethyl-4-piperidyl having the structure:

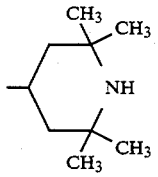

Especially preferred nucleating agent useful for producing high contrast and dot quality in images without incorporating boosters has the following structure wherein R is hydrogen or N-(2,2,6,6-tetramethyl-4-piperidyl)-carbamoyl or ethoxy carbonyl; $R_1$ is 2,2,6,6-tetramethyl-4-piperidyl, n-butyl, methyl or hydrogen; $R_2$ is n-butyl, methyl, hydrogen or phenyl hydrazino ethoxylate; and $R_3$ is hydrogen or n-butyl:

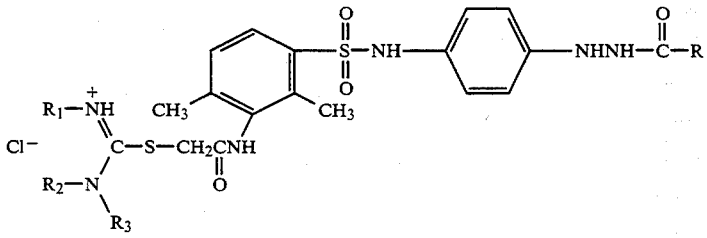

The nucleators of the invention are utilized by incorporation into a photographic element which comprises, among other materials, a light sensitive silver halide coating or layer on a substrate. The production of photographic elements is well known in the art as described in U.S. Pat. No. 4,988,604. Generally, the nucleators are applied to the substrate by incorporating them in the silver halide emulsion prior to coating of the substrate. However, the nucleators may be applied directly to the substrate or included with another coating material as it is applied to the substrate. After drying of the coated element, the element is ready for imagewise exposure.

The hydrazide nucleator of the invention is typically employed at a concentration of from about $1\times10^{-4}$ to about $5\times10^{-3}$ moles per mole of silver, more preferably in an amount of from about $2.5\times10^{-4}$ to about $2.5\times10^{-3}$ moles per mole of silver, and most preferably in an amount of from about $5\times10^{-4}$ to about $1.5\times10^{-3}$ moles per mole of silver.

The hydrazides are employed in this invention in combination with negative-working photographic emulsions comprised of radiation-sensitive silver halide grains capable of forming a surface latent image and a binder. The silver halide emulsions include high chloride emulsions conventionally employed in forming lithographic photographic elements, as well as silver bromide and silver bromoiodide emulsions which are recognized in the art as being capable of attaining higher photographic speed.

Silver halide emulsions contain a binder in addition to silver halide grains. The proportion of binder can be widely varied, but typically is within the range of from about 20 to 250 grams per mole of silver halide.

The silver halide emulsions can be spectrally sensitized with dyes from a variety of classes, including the polymethine dye class, which includes the cyanines, merocyanines, complex cyanines and merocyanines (i.e., tri-, tetra- and polynuclear cyanines and merocyanines), oxonols, hemioxonols, styryls and merostyryls. By a suitable choice of substituent groups, the dyes can be cationic, anionic or nonionic.

As noted herein before, an important advantage of the present invention is that boosters are not required in the film element or developer when the novel nucleators of the invention are used. While high contrast and speed with excellent dot quality as required for halftone applications is achieved through the application of the novel nucleators without boosters, the use of boosters is not, thereby, precluded in instant invention. For the compositions and processes of the invention, boosters can optionally be included and their use falls within the spirit and scope of the invention.

The layers of the photographic elements can be coated on a variety of supports. Typical photographic supports include polymeric film, paper, metallic sheet or foil, glass and ceramic elements. Typical of useful polymeric film supports are films of cellulose nitrate and cellulose esters such as cellulose triacetate and diacetate, polystyrene, polyamines, homo- and co-polymers of vinyl chloride, poly(vinyl acetal), polycarbonate, homo- and copolymers of olefins, such as polyethylene and polypropylene, and polyesters of dibasic aromatic carboxylic acids with divalent alcohols, such as poly(ethylene terephthalate).

The photographic elements can be imagewise exposed with various forms of energy, which encompass the ultraviolet and visible (e.g., actinic) and infrared regions of the electromagnetic spectrum as well as electron beam and beta radiation, gamma ray, X-ray, alpha particle, neutron radiation and other forms of corpuscular and wavelike radiant energy in either noncoherent (random phase) forms or coherent (in phase) forms, as produced by lasers. Exposures can be monochromatic, orthochromatic or panchromatic. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James in The theory of the Photographic Process, 4th Ed., MacMillan, 1977, Chapters 4, 6, 17, 18 and 23.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to specialized developers conventionally employed in conjunction with lithographic photographic elements to obtain very high contrast images.

It is preferred that the novel photographic elements of this invention are processed in developing compositions containing a dihydroxybenzene developing agent. It is more preferred that they are processed in a developing composition containing an auxiliary developing agent in addition to the dihydroxybenzene which functions as the primary developing agent. It is especially preferred that the auxiliary developing agent be phenidone-types (1-phenyl-3-pyrazolidinone).

The following examples are presented to illustrate the preparation of the novel nucleators of the invention and to compare their performance with nucleators of the prior art. The novel nucleators whose preparations are described hereinafter are representative examples of the nucleators of the invention generically described as structural formula (I) herein before.

EXAMPLE 1

Preparation of Comparative Hydrazine Nucleator

Comparative compound 1 was prepared as described in U.S. Pat. No. 4,988,604 and has following structure: (1)

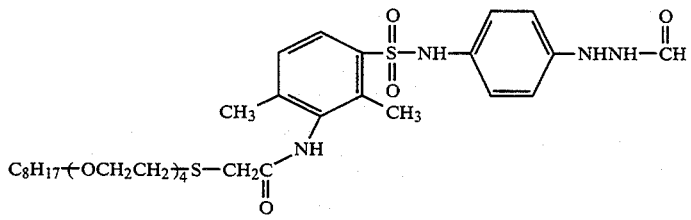

EXAMPLE 2

Preparation of Intermediate Compound A

Intermediate compound A was prepared according to the methods described in U.S. Pat. Nos. 4,030,925 and 4,994,365. The structure of intermediate A is as follows:

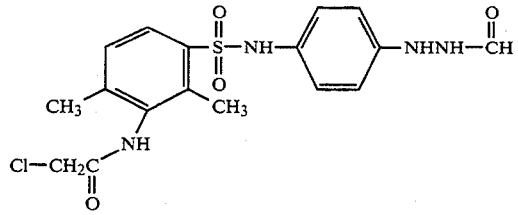

Preparation of Intermediate Compound B

Intermediate compound B was prepared according to the methods described in U.S. Pat. Nos. 5,158,856, 5,229,248 and 4,994,365. The structure of intermediate B is as follows:

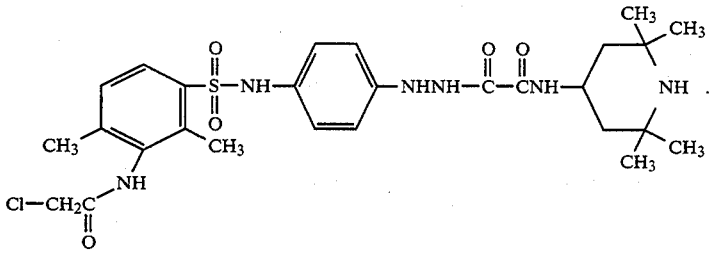

Preparation of Intermediate Compound C

An intermediate compound C was prepared according to the methods described in U.S. Pat. Nos. 4,686,167 and 4,994,365. Intermediate C has the following structure with a melting point of 175°-180° C.:

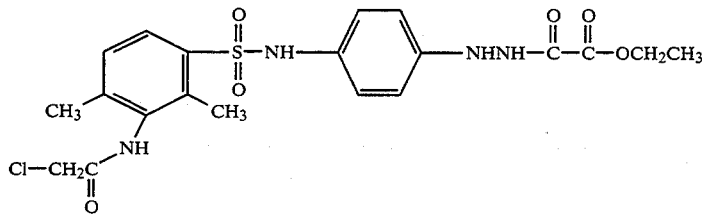

EXAMPLE 3

Preparation of Isothiouronium hydrazide Test Compounds 2–8

The isothiouronium nucleator compounds of the invention (compounds 2–8) were prepared by the reaction of either thiourea, or substituted thioureas, with either intermediate A, intermediate B or intermediate C. The thioureas were either commercially available or were prepared by reaction of the appropriate commercially available isothiocyanate with the requisite amine by methods well known in the art.

Compound 2

Compound 2, 1-[N-(2,2,6,6-tetramethyl-4piperidyl-)oxamoyl]-2-[4-(3-(2-(N'-(2,2,6,6-tetramethyl-4-piperidyl)-N''-n-butyl-2-isothiouronium chloride)acetamido)-2,4xylylsulfonamido)phenyl]hydrazide, was prepared by heating a mixture of 1.74 gram (0.0029 mole) of intermediate B and 1 gram (0.0037 mole) of N-[2,2,6,6tetramethylpiperidinyl]-N° -butylthiourea in 7 milliliters of N,N-dimethyl acetamide. Compound 2 was purified by dissolving in methanol and reprecipitating with an excess of isopropyl ether. The yield was 1.96 gram (77%). Melting point (softening, bubbling and clearing temperature in degrees C=250, 265, >300.

Compound 3

Compound 3, 1-formyl-2-[4-(3-(2-(N'-n-butyl-N''-n-butyl-2-isothiouronium chloride)acetamido)-2,4-xylyl sulfonamido)phenyl]hydrazide, was prepared by heating a mixture of 4.10 gram (0.0100 mole) of intermediate A and 2.26 grams (0.0120 mole) of 1,3-di-n-butylthiourea in 8 ml of N,N-dimethylacetamide on a steam bath for one hour. After cooling to room temperature, the reaction mixture was dissolved in 8 ml of methanol and poured into 250 ml of isopropyl ether. The isopropyl ether was decanted and the semisolid was again stirred with 250 ml of isopropyl ether. The crude product was recrystallized by dissolving into 25 ml of hot methanol, cooling to room temperature, and pouring into 200 ml of isopropyl ether. The solid was filtered, washed with a small amount of ether and air dried. It was recrystallized by dissolving in 18 ml of hot methanol and reprecipitated with an excess of isopropyl ether. The yield was 4.90 gram (82%). Melting point, turns clear at 225° C. after softening at 140° C. and bubbling at 160° C. Elemental analysis: calculated for $C_{26}H_{39}ClN_6O_4S_2$ is C=52.12, H=6.56, N=14.02, Cl=5.92, S=10.70,; found C=52.13, H=6.60. N=13.82, Cl=6.18, S=10.78.

Compounds 4, 5 and 6

Test compounds 4, 5 and 6 were prepared in a similar manner from appropriate intermediates. The melting points in degrees C for test compounds 4, 5 and 6 were respectively (softening, bubbling, clearing), no. 4=210, 230, 260; no. 5=170, 170, 225; no. 6=110, 135, 195.

Compound 4 is 1-formyl-2-[4-(3-(2-(N'-(2,2,6,6tetramethyl-4 -piperidyl )-N''-n-butyl-2 -isothiouronium chloride)acetamido)-2,4-xylylsulfonamido) phenyl]hydrazide. Compound 5 is 1-formyl-2-[4-(3-(2-(N'-methyl-N''-methyl-2-isothiouronium chloride)acetamido)-2,4-xylyl sulfonamido)phenyl]hydrazide. Compound 6 is 1-formyl-2-[4-(3 -(2-(1-di-n-butyl-3 -n-butyl-2 -isothiouronium chloride)acetamido)-2,4-xylyl sulfonamido)-phenyl]hydrazide.

The structure of compounds 2–6 pursuant to generic structure (I) of the invention when X is chloride are presented in Table 1 as follows:

TABLE 1

| CPD | $R_1$ | $R_2$ | $R_3$ | R |
|---|---|---|---|---|
| 2 | 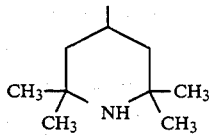 | n-Butyl | H | 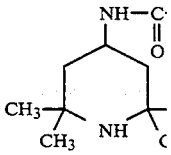 |
| 3 | N-Butyl | n-Butyl | H | H |
| 4 | 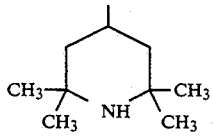 | n-Butyl | H | H |
| 5 | $CH_3$ | $CH_3$ | H | H |
| 6 | n-Butyl | n-Butyl | n-Butyl | H |

Compound 7

Compound 7, 1-[N-ethoxalyl]-2-[4-(3-(2-(N'-(n-butyl)-N''-(n-butyl)-2-isothiouronium chloride)acetamido)2,4-xylylsulfonamido)phenyl]hydrazide, was prepared from intermediate C and N,N'-di-n-butylthiourea as follows:

A mixture of 2.42 grams (0.0050 mole) of Intermediate C, 1.13 grams (0.0060 mole) of 1,3-dibutyl-2-thiourea and 5 mls of N,N-dimethyl acetamide was warmed on a steam bath for 1 and ½ hours. The reaction mixture was diluted with 5 mls of methanol and poured into 200 mls of isopropyl ether. The solid so obtained was filtered and stirred with fresh isopropyl ether. It was finally crystallized from methanol/isopropyl ether. Yield=1.7 g (51%), melting points in degrees C were (softening, bubbling, clearing) 120, 150, 230.

The structure of compound 7 as prepared from intermediate C is depicted as follows:

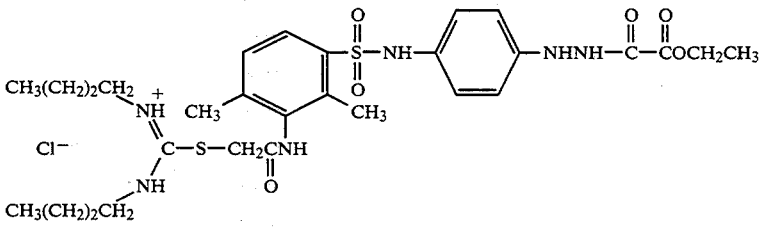

Compound 8

Compound 8 was prepared by the reaction of intermediate A with 2-ethoxalyl-(4'-[3''-butylthioureido]-phenyl)hydrazide, which itself was prepared by the reaction of butylisothiocyanate with ethoxalyl-2-[4'-aminophenyl]-hydrazide made as described in U.S. Pat. No. 4,686,167. The specific method was as follows: 2-ethoxalyl-(4'-[3''-butylthioureido]phenyl)hydrazide was prepared from 4.46 grams (0.02 mole) of ethoxalyl-2-[4'-aminophenyl]hydrazide and 2.76 grams of butylisocyanate in 63% yield (4.2 grams)), m.p. 140° C. with bubbling at 130° C. 2 grams (0.0049 mole) of intermediate A, 1.69 grams (0.0050 mole) of ethoxalyl-2-(4-[3-butylthioureido]-(phenyl)hydrazide and 8 mls of N,N-dimethylacetamide was heated in a steam bath for 1 and ½ hours. The reaction mixture was diluted and poured into isopropyl ether. It was purified from methanol/isopropyl ether. Yield 2.87 g (79%). Test compound 8 softens at 170° C., bubbles at 210° C. and is clear at 220° C.

The structure of compound 8 as prepared from intermediate A is depicted as follows:

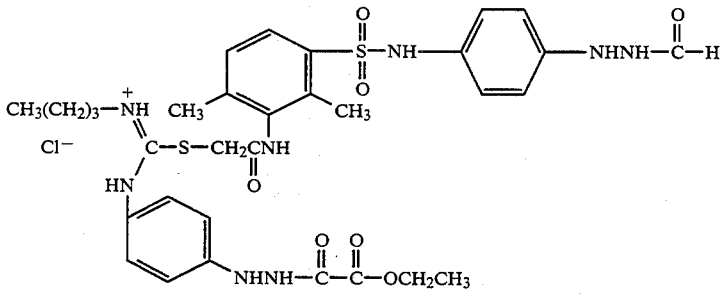

EXAMPLE 4

Photographic coatings containing Isothiouronium Nucleators Test Compounds 2–8 and Comparative Compound 1

Photographic coatings containing the compounds of the invention (2–8) were prepared according to the following procedure and compared after imagewise exposure with coatings incorporating Comparative Compound 1.

An 80:20 chloro-bromide emulsion having cubic crystals of 0.25 micron size was prepared by an ammoniacal method using a balanced double jet precipitation of one mole of 1.2 Normal silver nitrate, and a 1.55 mole mixture of potassium bromide-ammonium chloride with 2.2 grams per mole of ethylenediamine and 335 nanomole per mole of sodium hexachlororhodate, into a 3.6 weight percent gel solution at pH 8 over a 15 minute period at 35° C. The soluble by-product salts were removed by washing after coagulating the emulsion with an aromatic sulfonate at low pH. The emulsion was then redispersed to a 10 percent silver analysis with 55 grams per mole of gelatin, and was digested at 50° C. for 42 minutes at pH 6 in the presence of 0.05 mole of iodide, 7 mg of sodium benzenethiosulfinate, 11 micromoles of sodium tetrachloroaurate, and 31 micromoles of sodium thiosulfate. The emulsion was stabilized with 4500 micromoles of 4-Hydroxy-6-Methyl-l,3,3a,7-tetraazaindene, spectrally sensitized with 5-[(3-ethyl-2-thiazolidine)ethylidene]-4-oxo-2-thioxo-3-thiazolidine acetic acid. Sodium dioctylsulfosuccinate was added as a coating aid at 0.7 grams per mole of silver. A latex for dimensional stability, and the comparative compound and compounds 2–8 of the invention were added as methanol solutions. The emulsions were then coated onto a polyester base at 40 mg of silver per square decimeter, and were overcoated with an aqueous gelatin anti-abrasion layer containing dimethylolurea as a hardening agent. The dried film samples were exposed using a tungsten point source, and were processed in the developer whose composition is listed in Table 2. Sensitometric data for the films prepared as described herein are included in Table 3.

TABLE 2

| Developer composition (a) | |
|---|---|
| Ingredient | Amount |
| Potassium Bromide | 3.75 |
| Potassium Metabisulfite | 24 |
| Sodium Hydroxide, 50% | 40 |
| Potassium Carbonate, anhy. | 15.5 |
| Hydroquinone | 18.5 |
| Sodium Erythorbate | 2 |
| Phenidone-A | 0.2 |
| Benzotriazole | 0.1 |
| Irgaform 3000 | 1.25 |
| Diethylene Glycol | 8 |
| PMT | 0.035 |
| DTPA, 41% | 3 |
| Water | To 1.0 liter |
| pH | To 10.78 |

(a) All ingredients are in terms of grams per liter of working strength solution and processing conditions were 30 seconds at 38° C.

TABLE 3

| | Nucleator at $1 \times 10^{-3}$ m/m (b) | | | | Nucleator at $2 \times 10^{-3}$ m/m (b) | | | |
|---|---|---|---|---|---|---|---|---|
| Nucleator | S | G1 | G2 | Q | S | G1 | G2 | Q |
| None | 144 | 9.0 | 14.9 | 1 | 144 | 9.0 | 14.9 | 1 |
| Compd. 1 (c) | 144 | 15.0 | 7.5 | 3 | 174 | 15.5 | 6.1 | 3 |
| Compd. 2 (test) | 204 | 30.6 | 21.7 | 4 | 191 | 37.8 | 30.3 | 4 |
| Compd. 3 (test) | 205 | 19.7 | 11.9 | 4 | 194 | 19.3 | 19.6 | 4 |
| Compd. 4(test) | 187 | 16.9 | 14.9 | 4 | 174 | 18.8 | 12.2 | 4 |
| Compd. 5 (test) | 282 | 16.8 | 12.4 | 3 | 250 | 16.4 | 18.1 | 3 |
| Compd. 6 (test) | 151 | 15.8 | 10.3 | 3 | 160 | 17.4 | 12.1 | 3 |
| Compd. 7 (test) | 196 | 33.4 | 30.5 | 4.5 | 180 | 40.2 | 28.8 | 4.5 |
| Compd. 8 (test) | 241 | 22.2 | 14.1 | 4 | 250 | 24.7 | 19.6 | 4.5 |

(a) The films were exposed by a tungsten bulb through a 2 Log E continuous tone wedge. The speed (S) is expressed arithmetically as the antilogarithm of 3 minus the relative log exposure at an optical density of 0.5 above the base plus fog. The gradients were measured from the following density points:
G1 = 0.5 to 3.0; and G2 = 3.0 to 4.0. B + F is the base plus fog densities, which were all 0.04, and the maximum densities were all greater than 5.0. The halftone dot quality (Q) is expressed on a scale of 1 to 5, with 5 = excellent and 1 = poor, continuous tone type dots.
(b) The nucleators were tested at the two levels of 1 and $2 \times 10^{-3}$ moles of nucleator per mole of silver.
(c) Comparison hydrazine nucleator compound 1 (U.S. Pat. No. 4,988,604).

What is claimed is:

1. A silver halide lithographic film element having high contrast and dot quality developable in rapid access developers without requiring the use of boosters or alkanol amines, said element having coated thereon a silver halide emulsion and containing at least one layer incorporating a hydrazine nucleating agent having the structure

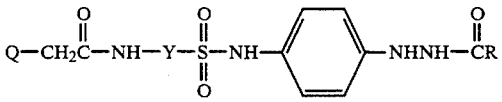

wherein R is hydrogen, $C_1$–$C_{10}$ alkyl, carbamoyl, alkoxy or aryloxy carbonyl; Y is divalent aryl, and Q is an isothiouronium salt moiety having the structure

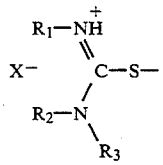

wherein $R_1$, $R_2$ and $R_3$, alike or different, are selected from the group consisting of hydrogen, phenyl or phenyl hydrazide, cycloalkyl or cycloalkenyl, $C_1$–$C_{12}$ alkyl or alkenyl, pyrrolidine, piperidine and aryl carbohydrazide; and X is an inorganic or organic anion.

2. The element of claim 1 wherein X is halide.

3. The element of claim 1 wherein said carbamoyl has the following structure wherein $R_4$ and $R_5$, alike or different, are selected from the group consisting of hydrogen, alkyl, alkenyl, aryl, pyrrolidyl and piperidyl,

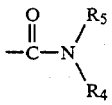

4. The element of claim 3 wherein said piperidyl comprises 2,2,6,6-tetramethyl-4-piperidyl having the structure

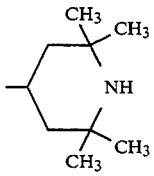

5. The element of claim 3 wherein said carbamoyl has the structure

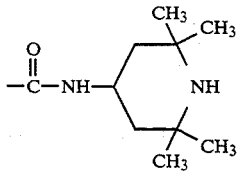

6. The element of claim 1 wherein said nucleating agent has the structure

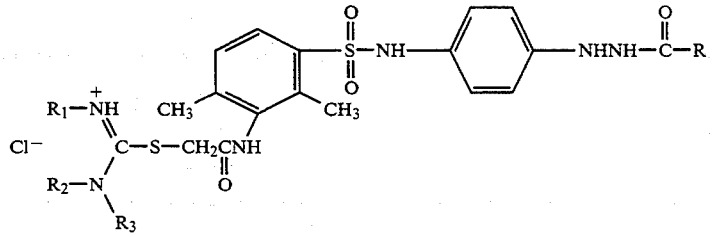

wherein R is hydrogen or N-(2,2,6,6-tetramethyl-4-piperidyl)-carbamoyl or ethoxy carbonyl; $R_1$ is 2,2,6,6-tetramethyl-4-piperidyl, n-butyl, methyl or hydrogen; $R_2$ is n-butyl, methyl or hydrogen; and $R_3$ is hydrogen or n-butyl.

7. The element of claim 1 wherein said nucleating agent has the following structure:

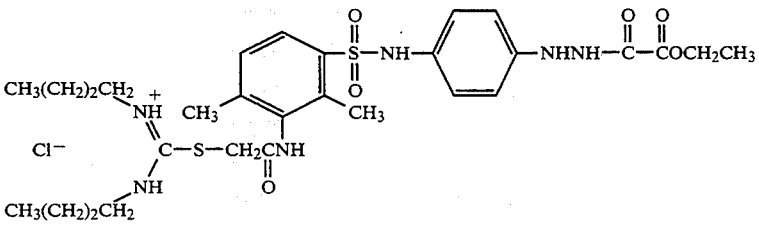

8. The element of claim 1 wherein said nucleating agent has the following structure:

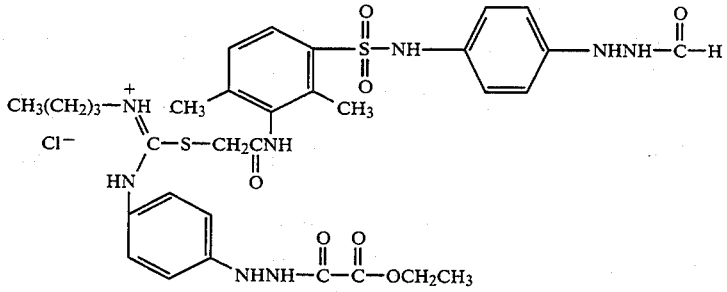

9. A process for forming a high contrast photographic image at high photographic speed with *superior dot quality which comprises imagewise exposing a silver halide photographic element and developing said exposed element in a developer solution having a pH between 9 and 11, wherein said element contains a photographic film nucleating agent having the structure

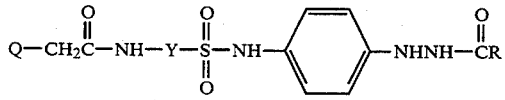

wherein R is hydrogen, $C_1$–$C_{10}$ alkyl, carbamoyl, alkoxy or aryloxy carbonyl; Y is divalent aryl, and Q is an isothiouronium salt moiety having the structure

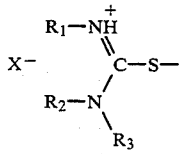

wherein $R_1$, $R_2$ and $R_3$, alike or different, are selected from the group consisting of hydrogen, phenyl or phenyl hydrazide, cycloalkyl, $C_1$–$C_{12}$ alkyl or alkenyl, pyrrolidine, piperidine and aryl carbohydrazide; and X is an inorganic or organic anion.

10. The process of claim 9 wherein said nucleating agent has the structure

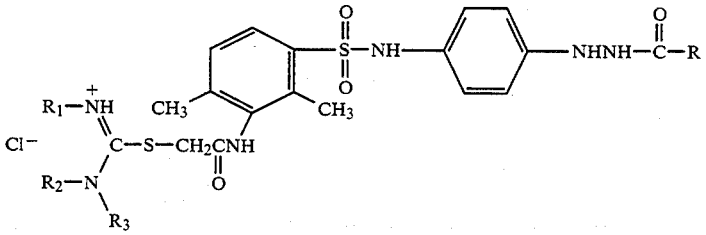

wherein R is hydrogen or N-(2,2,6,6-tetramethyl-4-piperidyl)-carbamoyl or ethoxy carbonyl; $R_1$ is 2,2,6,6-tetramethyl-4-piperidyl, n-butyl, methyl or hydrogen; $R_2$ is n-butyl, methyl or hydrogen; and $R_3$ is hydrogen or n-butyl.

11. The process of claim 9 wherein said film element contains between $1\times10^{-4}$ and $5\times10^{-3}$ moles of said nucleating agent per mole of silver.

12. The process of claim 9 wherein said element contains $1\times10^{-3}$ moles of said nucleating agent per mole of silver where R is N-(2,2,6,6-tetramethyl-4-piperidyl)-carbamoyl, $R_1$ is 2,2,6,6-tetramethyl-4-piperidyl, $R_2$ is n-butyl and $R_3$ is hydrogen.

13. The process of claim 9 wherein said nucleating agent comprises 1-[N-ethoxalyl]-2-[4-(3-(2-(N'-(n-butyl)-N''-(n-butyl)-2-isothiouronium chloride)acetamido)-2,4xylylsulfonamido)phenyl]hydrazide.

* * * * *